US011447958B2

(12) United States Patent
Strickland

(10) Patent No.: US 11,447,958 B2
(45) Date of Patent: Sep. 20, 2022

(54) VERTICAL SEALS FOR USE WITH EXTERIOR WALL PANEL ASSEMBLIES

(71) Applicant: INVENT TO BUILD INC., Richmond Hill (CA)

(72) Inventor: Michael R. Strickland, Richmond Hill (CA)

(73) Assignee: INVENT TO BUILD INC., Richmond Hill (CA)

( * ) Notice: Subject to any disclaimer, the term of this patent is extended or adjusted under 35 U.S.C. 154(b) by 0 days.

(21) Appl. No.: 16/783,453

(22) Filed: Feb. 6, 2020

(65) Prior Publication Data

US 2020/0256061 A1 Aug. 13, 2020

Related U.S. Application Data

(60) Provisional application No. 62/802,552, filed on Feb. 7, 2019, provisional application No. 62/849,696, filed on May 17, 2019.

(51) Int. Cl.

| | |
|---|---|
| ***E04B 2/00*** | (2006.01) |
| ***E04F 13/08*** | (2006.01) |
| ***E04B 1/76*** | (2006.01) |

(52) U.S. Cl.

CPC ..... *E04F 13/0821* (2013.01); *E04B 1/762* (2013.01)

(58) Field of Classification Search

CPC ..... E04B 1/762; E04B 1/6813; E04F 13/0821

See application file for complete search history.

(56) References Cited

U.S. PATENT DOCUMENTS

| | | | | |
|---|---|---|---|---|
| 2,156,681 | A * | 5/1939 | Dewhirst | F16L 21/025 404/65 |
| 2,680,370 | A | 6/1954 | Spaight | |
| 3,099,110 | A | 7/1963 | Spaight | |
| 3,205,629 | A | 9/1965 | Rumley et al. | |
| 3,218,941 | A * | 11/1965 | Daum | E04B 1/68 404/65 |
| 3,447,430 | A | 6/1969 | Gausepohl | |
| 3,527,009 | A | 9/1970 | Nyquist | |

(Continued)

FOREIGN PATENT DOCUMENTS

| | | |
|---|---|---|
| CA | 2166593 A1 | 7/1997 |
| CH | 511343 A | 8/1971 |

(Continued)

OTHER PUBLICATIONS

International Search Report for PCT/CA2018/051118, dated Jan. 24, 2019.

*Primary Examiner* — Basil S Katcheves
(74) *Attorney, Agent, or Firm* — Hill & Schumacher

(57) ABSTRACT

An exterior wall panel assembly includes an exterior wall panel, a vertical seal and a horizontal seal. The exterior wall panel has a top, a bottom and opposed sides. The vertical seal is affixed to one side of the exterior wall panel and extends from the top to the bottom of the exterior wall panel. The horizontal seal is affixed to the top of the exterior wall panel. The horizontal seal extends along the top and is spaced inwardly from each opposed side. An exterior wall panel system includes at least two exterior wall panel assemblies and a horizontal splice. The horizontal splice is positioned between horizontal seals on adjacent exterior wall panels and is sealingly attached thereto.

6 Claims, 14 Drawing Sheets

(56) References Cited

U.S. PATENT DOCUMENTS

| | | | | | |
|---|---|---|---|---|---|
| 3,598,026 | A * | 8/1971 | Johnson | E04B 1/6815 | 404/49 |
| 3,606,826 | A * | 9/1971 | Bowman | E04B 1/6803 | 404/49 |
| 3,682,053 | A * | 8/1972 | Kerschner | E01D 19/06 | 404/65 |
| 3,788,021 | A | 1/1974 | Husler | | |
| 4,030,156 | A * | 6/1977 | Raymond | E01D 19/06 | 14/73.1 |
| 4,110,948 | A | 9/1978 | Maier, Jr. | | |
| 4,111,584 | A | 9/1978 | Fyfe | | |
| 4,132,491 | A * | 1/1979 | Scheffel | E01D 19/062 | 404/56 |
| 4,351,622 | A * | 9/1982 | Kerschner | E01C 11/106 | 404/64 |
| 4,522,413 | A * | 6/1985 | Nicholas | E01C 11/106 | 277/645 |
| 4,773,791 | A | 9/1988 | Hartkorn | | |
| 4,843,791 | A | 7/1989 | Michlovic | | |
| 4,854,095 | A | 8/1989 | Michlovic | | |
| 4,884,381 | A | 12/1989 | Betti | | |
| 4,916,878 | A * | 4/1990 | Nicholas | E04B 1/6803 | 404/47 |
| 5,048,249 | A * | 9/1991 | Shreiner | E04B 1/6804 | 52/396.07 |
| 5,076,034 | A | 12/1991 | Bandy | | |
| 5,092,095 | A | 3/1992 | Zadok et al. | | |
| 5,129,754 | A | 7/1992 | Brower | | |
| 5,212,922 | A | 5/1993 | Werner | | |
| 5,347,778 | A | 9/1994 | Bray | | |
| 5,469,683 | A | 11/1995 | Mckenna et al. | | |
| 6,253,514 | B1 | 7/2001 | Jobe et al. | | |
| 6,484,465 | B2 | 11/2002 | Higgins | | |
| 8,132,380 | B2 | 3/2012 | Wilkes, Jr. | | |
| 8,887,463 | B2 | 11/2014 | Derrigan et al. | | |
| 9,212,746 | B2 * | 12/2015 | McDowell | E01C 11/02 | |
| 9,322,163 | B1 | 4/2016 | Hensley | | |
| 9,464,432 | B2 | 10/2016 | Lang et al. | | |
| D781,466 | S * | 3/2017 | Winslow | D25/164 | |
| 9,850,626 | B2 * | 12/2017 | Busch | E01C 11/04 | |
| 10,385,564 | B2 | 8/2019 | Fisher et al. | | |
| 2005/0066600 | A1 | 3/2005 | Moulton et al. | | |
| 2012/0141190 | A1 * | 6/2012 | Bailey | E01C 11/106 | 403/28 |
| 2015/0042047 | A1 * | 2/2015 | Winslow | B29D 99/0053 | 277/637 |
| 2019/0078323 | A1 | 3/2019 | Strickland | | |
| 2019/0078324 | A1 | 3/2019 | Strickland | | |
| 2019/0169836 | A1 | 6/2019 | Fisher et al. | | |

FOREIGN PATENT DOCUMENTS

| | | | |
|---|---|---|---|
| DE | 1805484 | A1 | 5/1969 |
| DE | 202004017823 | U1 | 3/2006 |
| FR | 3017684 | A1 | 2/2014 |
| GB | 249165 | A | 1/1927 |
| JP | 2015163762 | A | 9/2015 |
| KR | 200420845 | Y1 | 7/2006 |
| WO | 9913174 | A1 | 3/1999 |
| WO | 2007048188 | A1 | 5/2007 |
| WO | 2017017053 | A1 | 2/2017 |

* cited by examiner

VERTICAL SEALS FOR USE WITH EXTERIOR WALL PANEL ASSEMBLIES

FIELD OF THE DISCLOSURE

This disclosure relates to exterior wall panel assemblies and wall systems using same.

BACKGROUND

There are two commonly used light weight exterior wall panel systems used in the construction industry today, namely aluminium framed curtain walls and exterior insulated finish system (EIFS).

Aluminium framed curtain wall panels are the most common method for providing exterior walls on multi-story buildings. They have extruded dry-seal systems that protect the building against air and water infiltration and provide superior longevity. A dry seal system can be designed to incorporate the rainscreen principle, so the joint can be pressure equalized to help keep moisture away from the seals. The panels can incorporate windows, stone finish or a metal finish. The downside of unitized curtain wall panels is that they perform quite poorly regarding thermal protection of the building.

Exterior insulated panels (sometimes referred to as EIFS) are becoming more commonly used today for multi-story curtain wall construction. When these panels are properly designed and installed, they provide optimum thermal protection for the building. Unfortunately, this type of construction typically requires the joints between the panels to be caulked after the panels are erected. Caulking is what is known as a wet-seal system, which is subject to human error and inclement weather. Caulked joints do not provide the same level of quality and endurance as dry-seal systems and incorporating the rainscreen principle is difficult to do with caulked joints. Unfortunately, caulking the joints needs to be done using scaffolding or swing stages located on the outside of the building. This can be costly and makes the work more dangerous to do. The latter is expensive and adds time required to complete the installation. Caulking is also problematic when the proximity of the adjacent building is too close to the new wall to allow access. Additionally, caulking requires skilled labourers and detailed inspection to ensure that the caulked joints are sealed properly.

Dry seal systems for EIFS exist, however they are only capable of sealing relatively small gaps between wall panels with small construction tolerances. This is a problem because cold formed steel framed curtain wall panels and EIFS typically have large construction tolerances. This means that one cannot use a rigid dry seal because the gap between two panels may vary along the shared length of the panels.

Therefore, it would be advantageous to provide a seal system which reduces the work required to be done on the construction site.

SUMMARY

The present disclosure relates to an exterior wall panel assembly. The exterior wall panel assembly includes an exterior wall panel, a vertical wall panel and a horizontal seal. The exterior wall panel has a top, bottom and opposed sides. The vertical seal is affixed to one side of the exterior wall panel and extends from the top to the bottom of the exterior wall panel. The horizontal seal is affixed to the top of the exterior wall panel extends along the top and spaced inwardly from each opposed side.

The vertical seal and the horizontal seal may be resiliently deformable.

The resiliently deformable vertical seal may have at least two vertical chambers.

The at least two vertical chambers of the vertical seal may be defined by opposed vertical side walls and a plurality of vertical end walls extending therebetween and each vertical end wall may have a bend therein thereby allowing the opposed walls to move relative to each other.

The vertical seal may have a plurality of ribs extending outwardly therefrom on either side thereof.

The vertical seal may be configured to be filled with flowable caulking. The flowable caulking may be a self-levelling caulking.

The plurality of ribs may extend outwardly from opposed vertical side walls and opposed vertical side walls may be an interior vertical side wall affixed to the exterior wall panel and an exterior vertical side wall and wherein at least one hole may be provided in the exterior vertical seal side wall whereby when filled the flowable caulking material flows into a faying area defined by the walls, the ribs and the adjacent exterior wall panel. At least one hole may be provided in the interior vertical side wall whereby when filled the flowable caulking material flows into a faying area defined by the walls, the ribs and the interior insulated panel.

The width of the vertical seal may be less than the width of the horizontal seal.

The horizontal seal may have at least four elongate chambers.

The horizontal seal may have a plurality of feet extending upwardly and downwardly therefrom and the feet are elongate feet extending the length of the horizontal seal.

The vertical seal and the horizontal seal may be affixed to the exterior wall panel with buttered silicone sealant.

The exterior wall panel assembly may further include a rain screen operably attached to the vertical seal and extending the length of the vertical seal.

The rainscreen may be attached to the vertical seal with a male/female connection.

The vertical seal and the horizontal seal may be made from silicone rubber.

An exterior wall panel system includes at least two exterior wall panel assemblies, and a horizontal spice. The horizontal splice is positioned between horizontal seals on adjacent exterior wall panels and sealingly attached thereto.

The horizontal splice may be sealingly attached to the adjacent horizontal seals with silicone sealant.

The horizontal splice sealingly attached to the adjacent horizontal seals may further include a front silicone sheet and a back silicone sheet.

The top of the horizontal seals may be buttered with silicone sealant and the vertical seals of vertically adjacent exterior wall panel assemblies may be embedded into the silicone sealant on the top of the horizontal seals.

A method of forming an exterior wall for a building structure comprising the step of: a) attaching a first exterior wall panel assembly to the building structure; b) attaching a second exterior wall panel assembly to the building structure horizontally adjacent to the first exterior wall panel assembly; c) sealingly attaching a horizontal splice between horizontal seals on adjacent exterior wall panels; and repeating steps a) to c).

A vertical seal is for use with adjacent exterior wall insulated panels. The vertical seal includes opposed vertical side walls and at least two vertical side walls. The opposed vertical side walls are resiliently deformable. The at least two vertical end walls extend between the opposed vertical side end walls, are resiliently deformable and each have a bend therein. The opposed vertical side walls and the at least two vertical end walls define at least one cavity and wherein the bend in the vertical end walls facilitates movement of the opposed vertical side walls relative to each other.

A plurality of ribs may extend outwardly from and longitudinally along the opposed vertical side walls.

The at least two vertical end walls may be three spaced apart end walls defining two chambers.

The vertical seal may be configured for use with flowable calking.

At least one of the opposed vertical side walls may have at least one hole formed therein.

Further features will be described or will become apparent in the course of the following detailed description.

BRIEF DESCRIPTION OF THE DRAWINGS

The embodiments will now be described by way of example only, with reference to the accompanying drawings, in which.

DETAILED DESCRIPTION

The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention. For purposes of teaching and not limitation, the illustrated embodiments are directed to exterior wall panel assemblies.

Figures 1A, 1B:
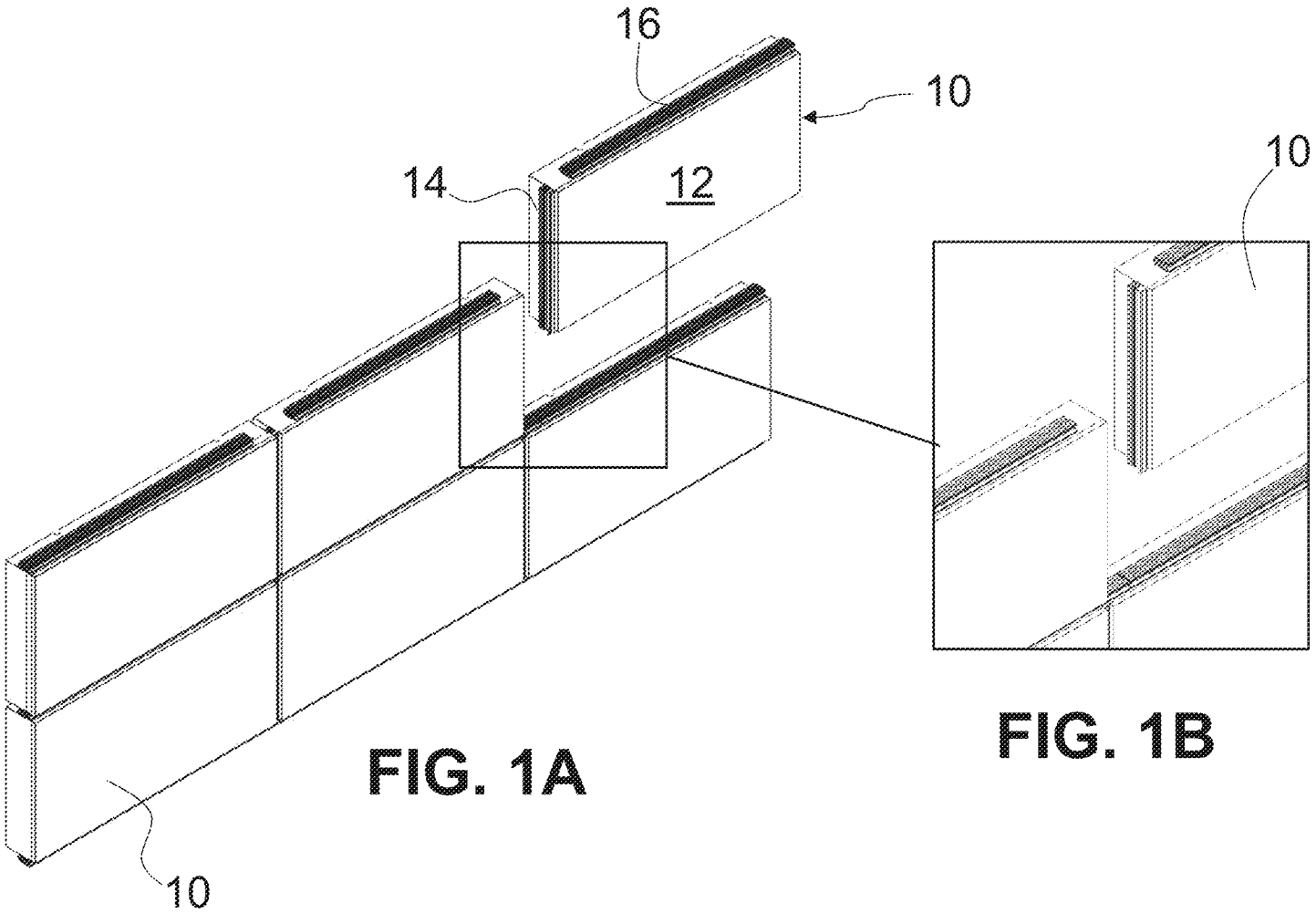
FIG. 1A is perspective view of an exterior wall panel system.
FIG. 1B is an enlarged perspective view of the exterior wall panel system.
Figures 2A, 2B:
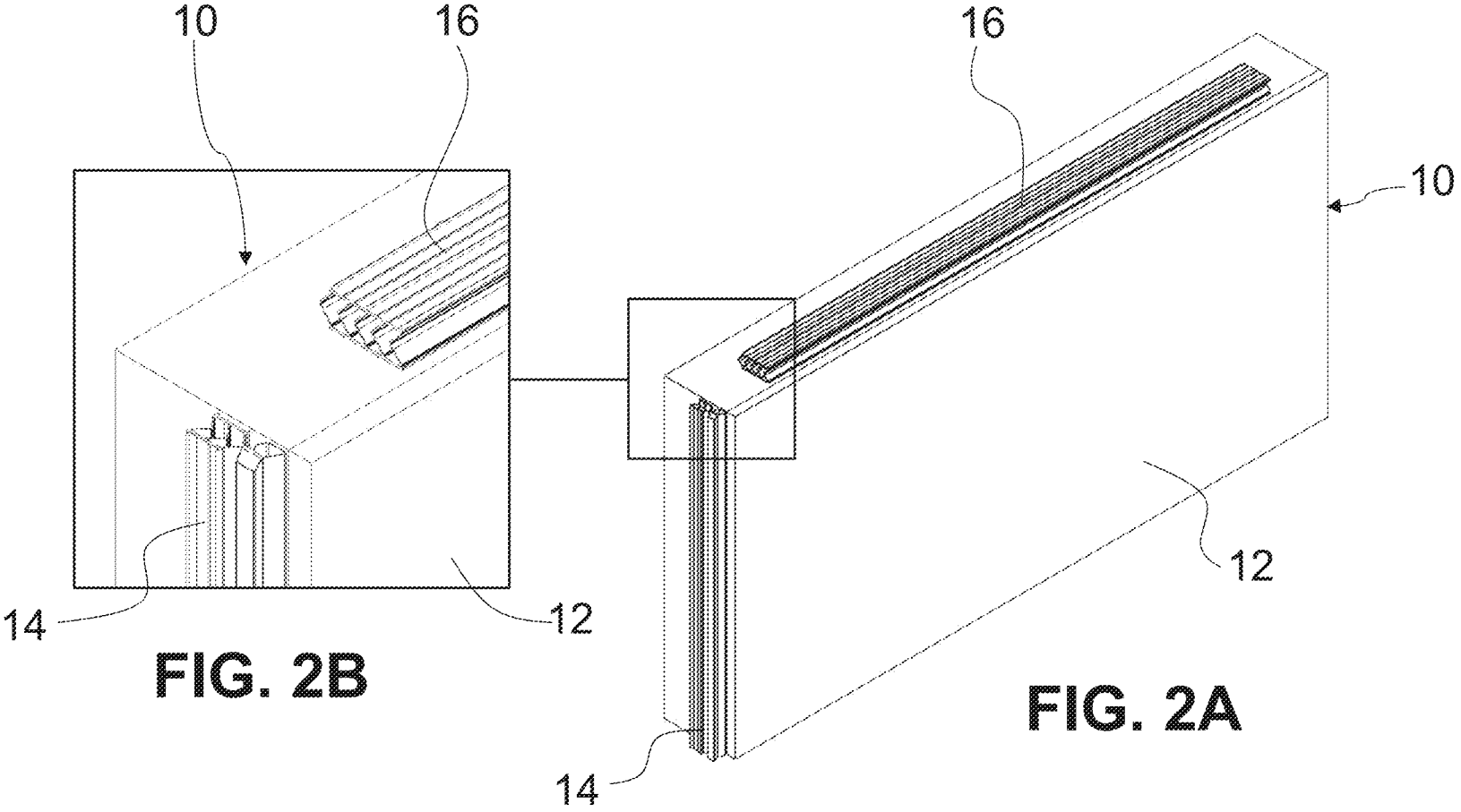
FIG. 2A is a perspective view of an exterior wall panel assembly used in the exterior wall panel system of FIG. 1A.
FIG. 2B is an enlarged perspective view of a corner of the exterior wall panel assembly shown in FIG. 2A.

Referring to FIGS. 1A and 1B, an exterior wall panel assembly is shown generally at 10. A plurality of exterior wall panel assemblies 10 are used to form an exterior wall for a building structure. It will be appreciated by those skilled in the art that size of the exterior wall panel assembly 10 may vary and can be determined by the user. However, one efficient size is that the exterior wall panel is the size of a floor of the building. Thus, the exterior wall may be erected floor by floor.

The exterior wall panel assembly 10 includes an exterior wall panel 12, a vertical seal 14 and a horizontal seal 16. The exterior wall panel assembly 10 preferably is assembled off site.

Figure 3:
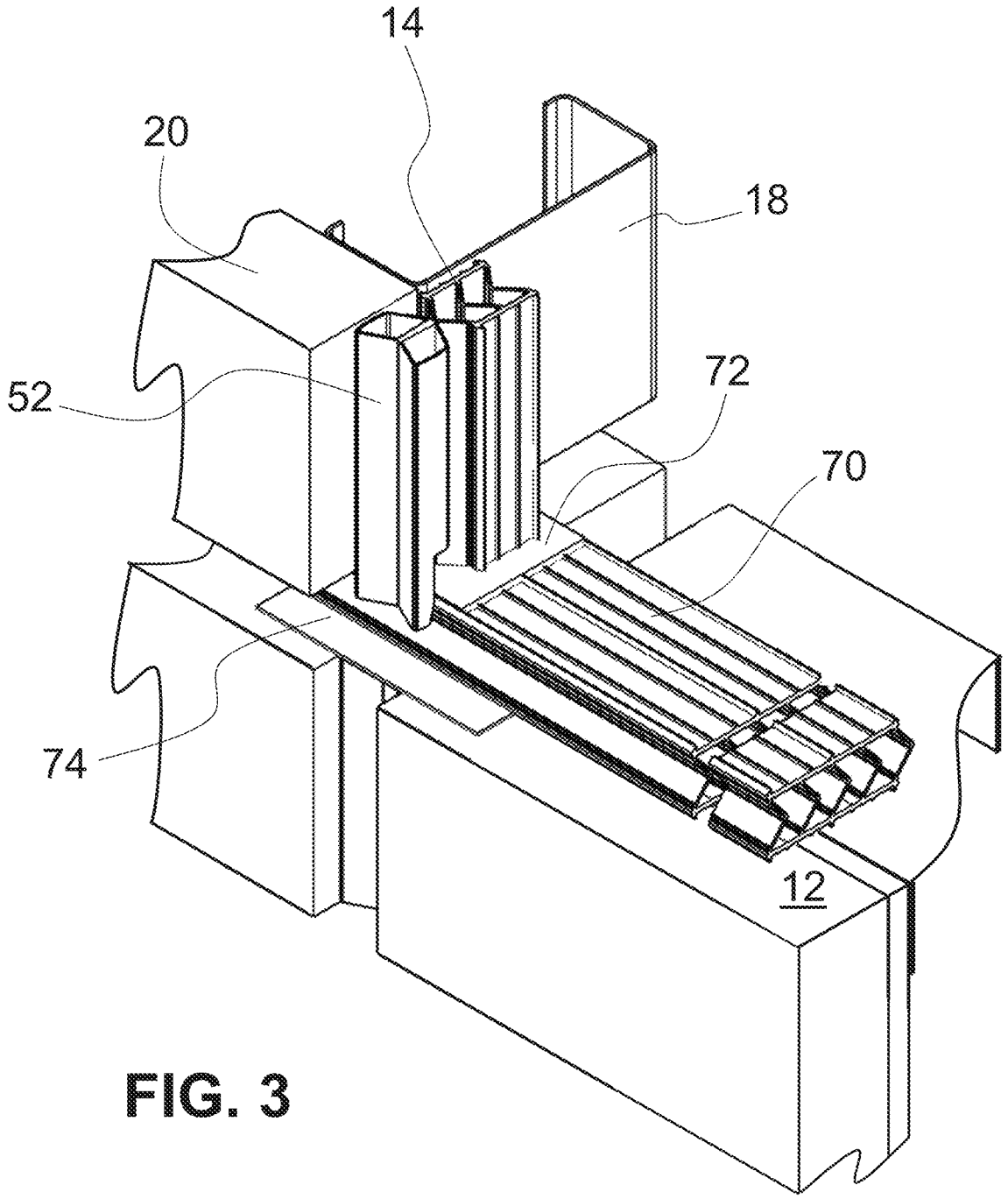
FIG. 3 is an enlarged perspective view of the connection between adjacent exterior wall panel assemblies.
Figures 4A, 4B:
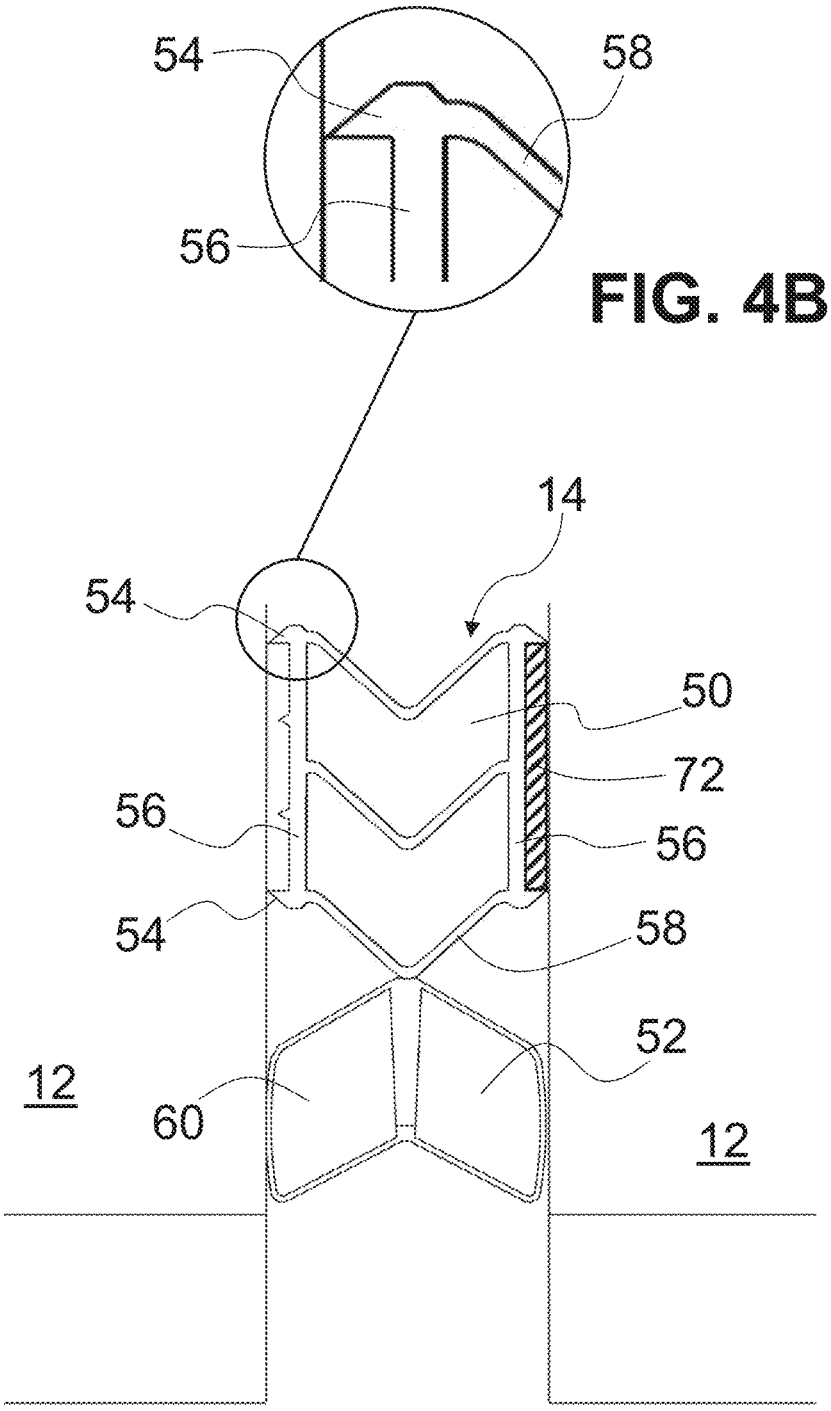
FIG. 4A is a top view of the vertical seal.
FIG. 4B is an enlarged top view of a rib of the vertical seal.
Figure 5:
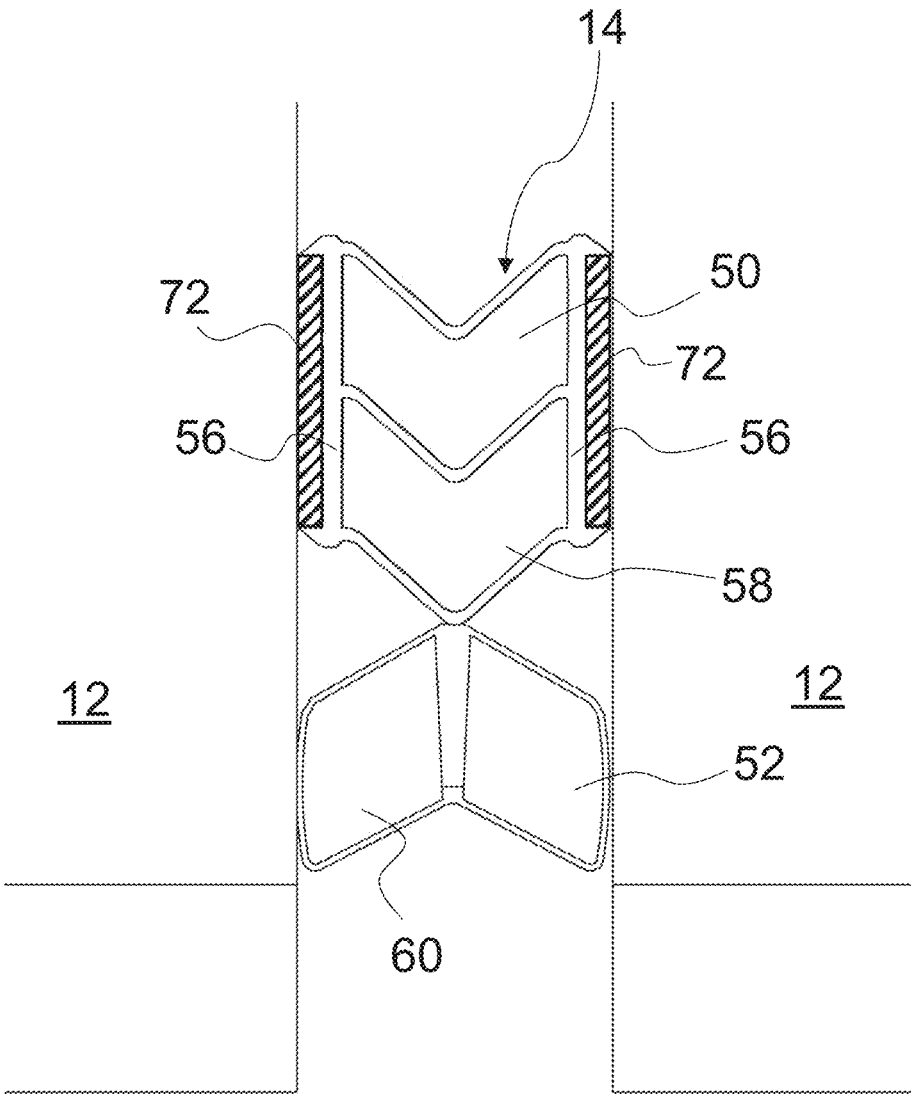
FIG. 5 is a top view of the vertical seal similar to that shown in FIG. 4A but showing an alternate side seal.

The exterior wall panel 12 shown herein is an exterior insulated wall panel that includes a steel frame portion 18 and an exterior insulation portion 20. It will be appreciated by those skilled in the art that the assembly described here could be used with other types of wall panels and is not limited to exterior insulated wall panels. Further it will be appreciated that the number and composition of the layers of the wall panel assembly 10 may vary depending on the user's needs. Referring to FIGS. 3 to 5, the vertical seal 14 includes at least one chamber 50 and an optional rainscreen portion 52. In the embodiment shown herein there are two chambers but it will be appreciated by those skilled in the art that the user may determine the number of chambers 50. The chamber portion 50 has an opposed vertical side walls 56 and a plurality of vertical end walls 58 extending between the vertical side walls 56. Each vertical side wall 56 has a plurality of ribs 54 extending outwardly from and longitudinally along the vertical side walls 56. Preferably the ribs 54 have pointed bearing tips to facilitate a continuous seal. The vertical side walls 56 have a plurality of holes formed therein. The vertical end walls 58 have a bend formed therein to facilitate movement of the vertical end walls 58 relative to each other. The movement of the vertical end walls 58 of the chamber portion 50 of the vertical seal 14 allows for accommodating different tolerances in exterior wall panels 12. A faying area is between the vertical side walls 56 and the exterior insulated panels 12, the width of which is defined by the ribs 54. The faying area is filled with silicone sealant 72 to affix the vertical seal 14 to the wall panel 12. One side of the vertical seal 14 is affixed to the panel off site. Optionally the other side of the vertical seal 14 may also be affixed to a wall panel with silicone sealant on site as shown in FIG. 5.

In use the chamber portion 50 of the vertical seal 14 is positioned between adjacent exterior insulated panels 12. The vertical seal 14 is configured to provide a continuous seal between adjacent exterior insulated panels 12.

Figure 6:
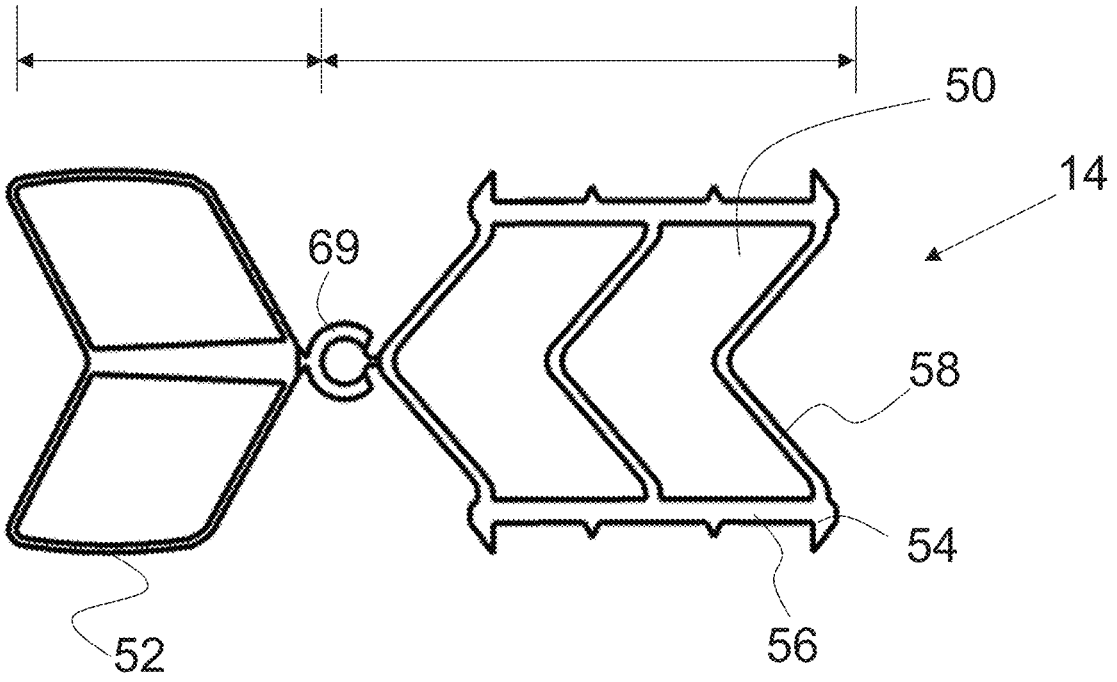
FIG. 6 is an enlarged perspective view of the connection between the adjacent exterior wall panel assemblies similar to that shown in FIG. 3 but showing an alternate vertical seal.
Figure 7:
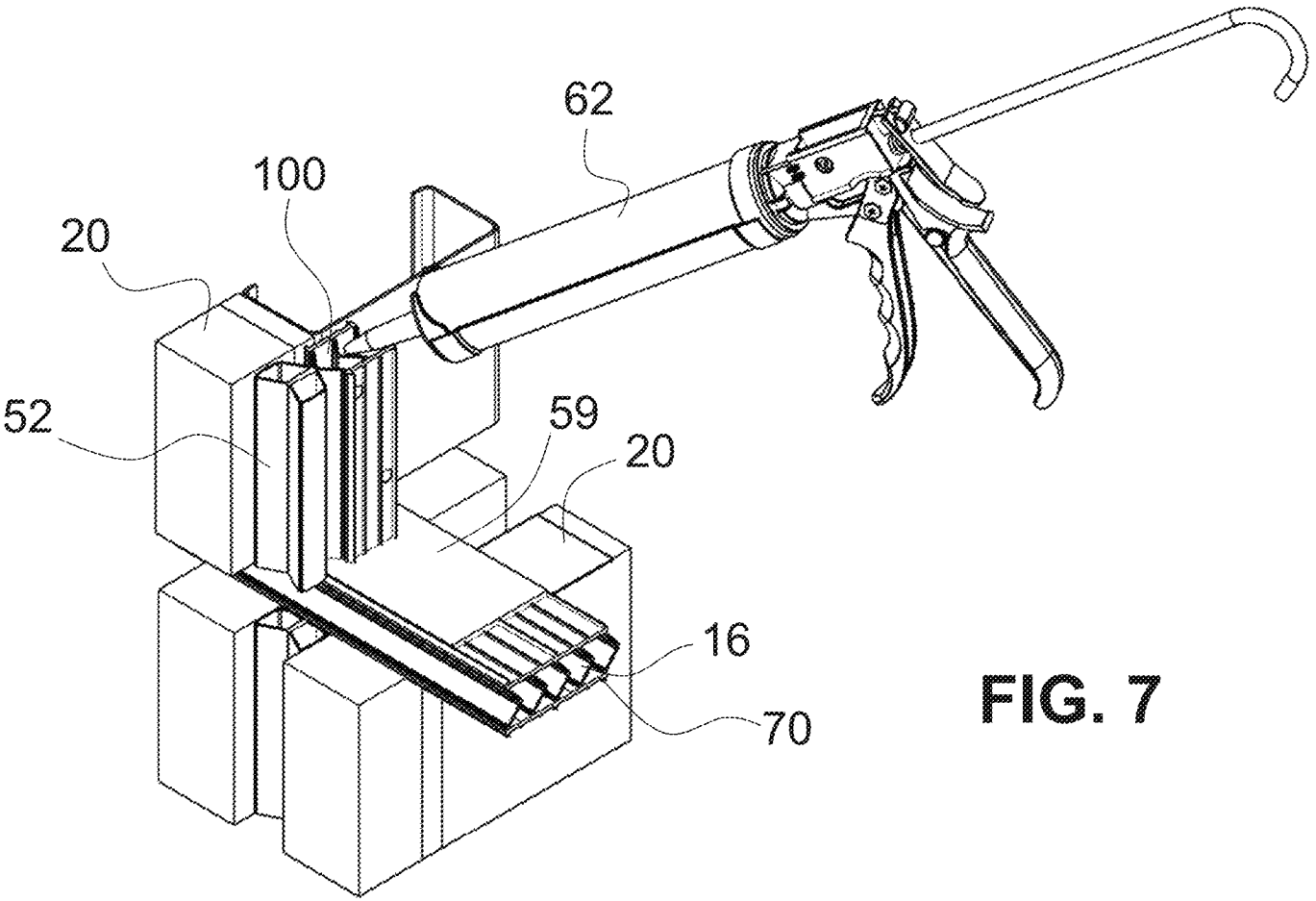
FIG. 7 is a perspective view of the connection between the adjacent exterior wall panel assemblies similar to that shown in FIG. 6 but showing the alternate vertical seal being filled with flowable caulking.
Figure 8:
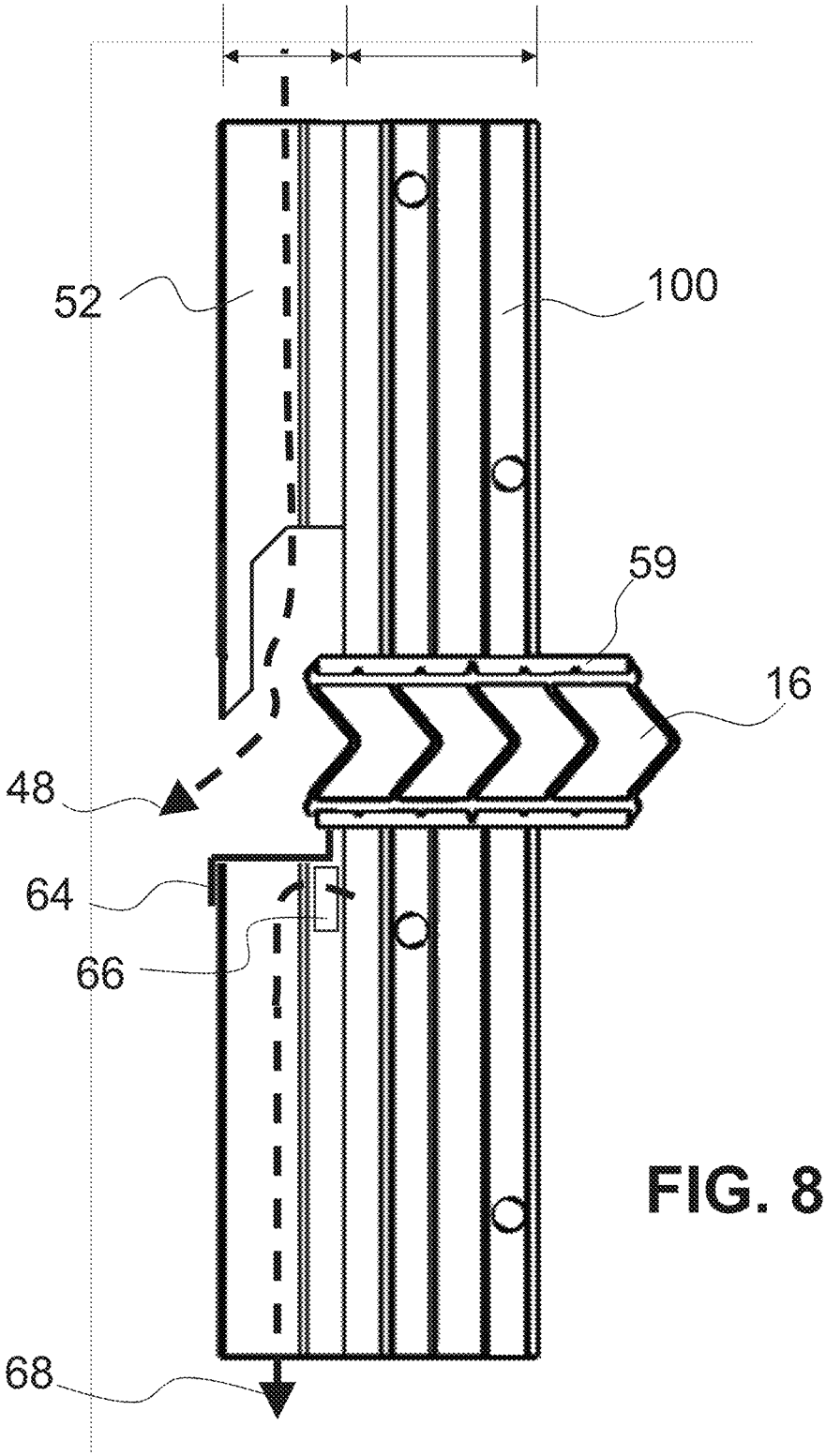
FIG. 8 is a side view of the connection of FIGS. 6 and 7

FIGS. 6 to 8 show an alternate embodiment of a vertical seal 100. Vertical seal 100 is similar to vertical seal 14 described above but vertical seal 100 is configured for use with flowable caulking. Only those elements of vertical seal 100 which are different from vertical seal 14 will be discussed in detail. The chamber 50 has opposed vertical side walls 56 and at least a pair of vertical end walls 58 extending between the vertical side walls 56. The opposed vertical side walls 56 include an interior side wall 53 which preferably is attached to the exterior insulated panel 20 off site and an exterior side wall 55. In the embodiment shown herein there are three end walls 58 forming two cambers 50. The vertical side walls 56 have a plurality of holes 57 formed therein. A faying area is between the side walls 56 and the exterior insulated panels 20, the width of which is defined by the ribs 54.

In use the vertical seal 100 is positioned between adjacent exterior insulated panels 20. The vertical seal 100 is configured to provide a continuous seal between adjacent exterior insulated panels 20. The vertical seal 100 is configured to be filled with flowable caulking. Chamber 50 is configured to be a sealed chamber such that when the flowable caulking is filled the chamber fills up. This provides an in situ visual determination of whether a continuous seal is being achieved. With the vertical seal 100 being made of translucent material a visual check can then be made to confirm that the flowable caulking has filled the chamber 50 of the vertical seal 100. Holes 57 are provided to ensure that the flowable caulking flows through and fills the portion between the ribs 54 and the panels 20 creating a bond. It will be appreciated by those skilled in the art that if the vertical seal 100 is attached to a panel 20 off site, possibly holes 57 may only be provided in exterior side wall 55. In use, a bed of caulking 59 is laid on top side of the horizontal seal 16. The vertical seal 100 is embedded into bed of caulking 59 and seals the bottom of the chamber 50 so that the flowable caulking will not flow out.

As shown in FIG. 7 a caulking gun 62 may be used to fill the chamber 50 with flowable caulking. However, it will be appreciated by those skilled in the art that other tools may be used to deliver the flowable caulking to the top of the chamber 50. By using flowable caulking or self-levelling silicone caulking the chamber 50 of the vertical seal 100 can be filled from the top as no tooling pressure is required in order for caulking to bond with panel surfaces. Flowable caulking is inserted into top of vertical seal 100 and it flows downward with the force of gravity and completely fills all voids. Holes 57 are provided in order for caulking to flow into faying area between the seal and the panel, which creates a bonded seal. Flowable caulking comes out of the holes 57 and fills the faying area.

Figure 9:
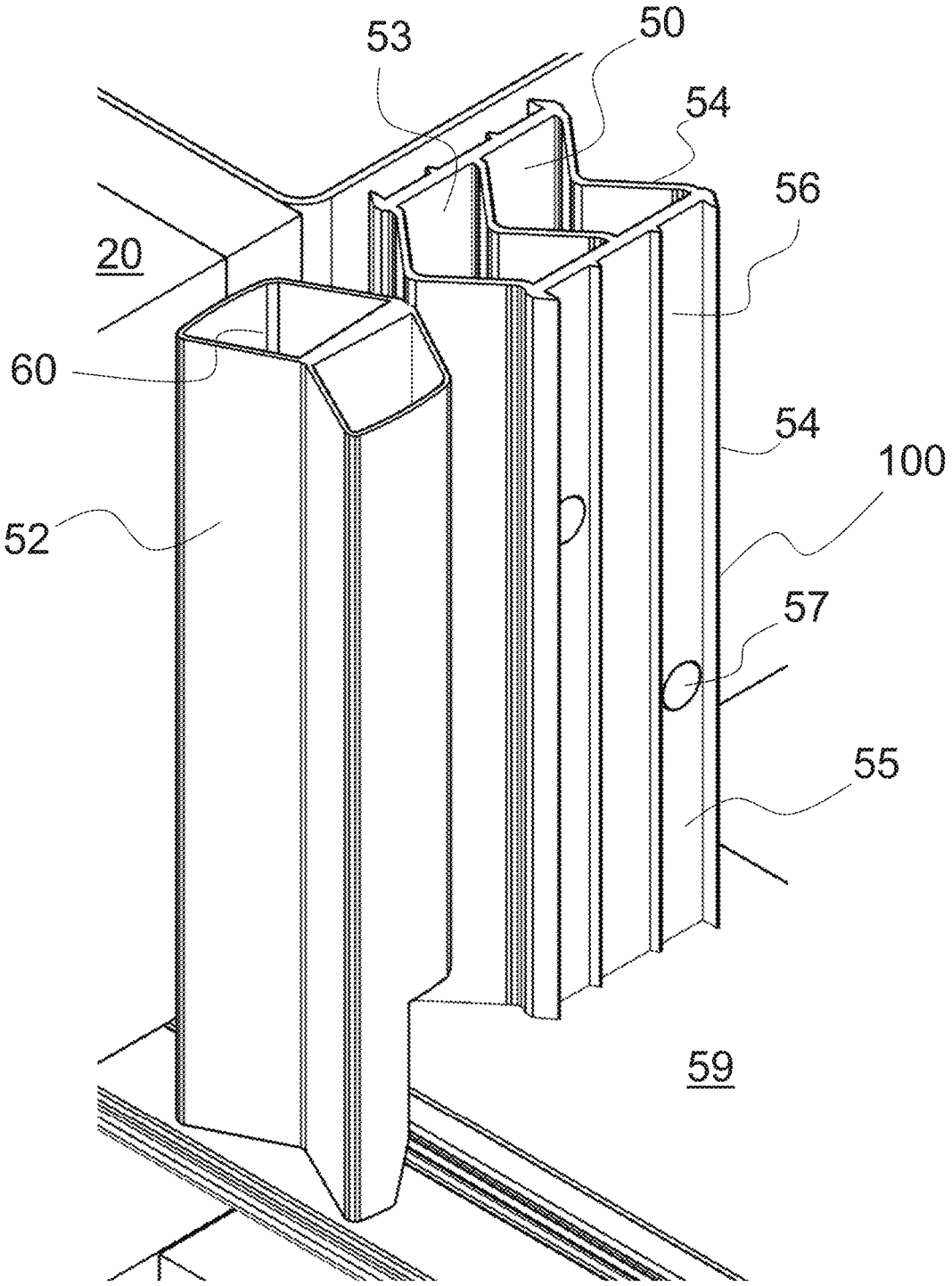
FIG. 9 is an enlarged top view of a vertical seal and a rain screen and showing a male/female joint therebetween.

The rainscreen 52 is operably attached to the vertical chamber 50 and extends downwardly along the front of the vertical chamber. In the embodiments shown herein the optional rainscreen 52 has two chambers 60. The rainscreen 52 extends downwardly below the bottom of the panel assembly 10 as best seen in FIGS. 3 and 6. A cap 64 is provided on the top of the rainscreen 52 which caps the top of the chamber defined by the rainscreen 52. A hole 68 in back side of rainscreen 52 allows cavity to be vented. The rainscreen 52 drains passively as shown by arrows 68 on FIG. 8. The rain screen 52 may be attachable to the vertical chamber 50 by a male/female connection 69 as shown in FIG. 9. This allows for an easy method of changing the colour and/or the shape of the rain screen. This also allows for an easy way to provide rain screens 52 that can be positioned at different positions in/out relative to the chamber 50 to accommodate alternative finish types and site specific design conditions.

Figure 11:
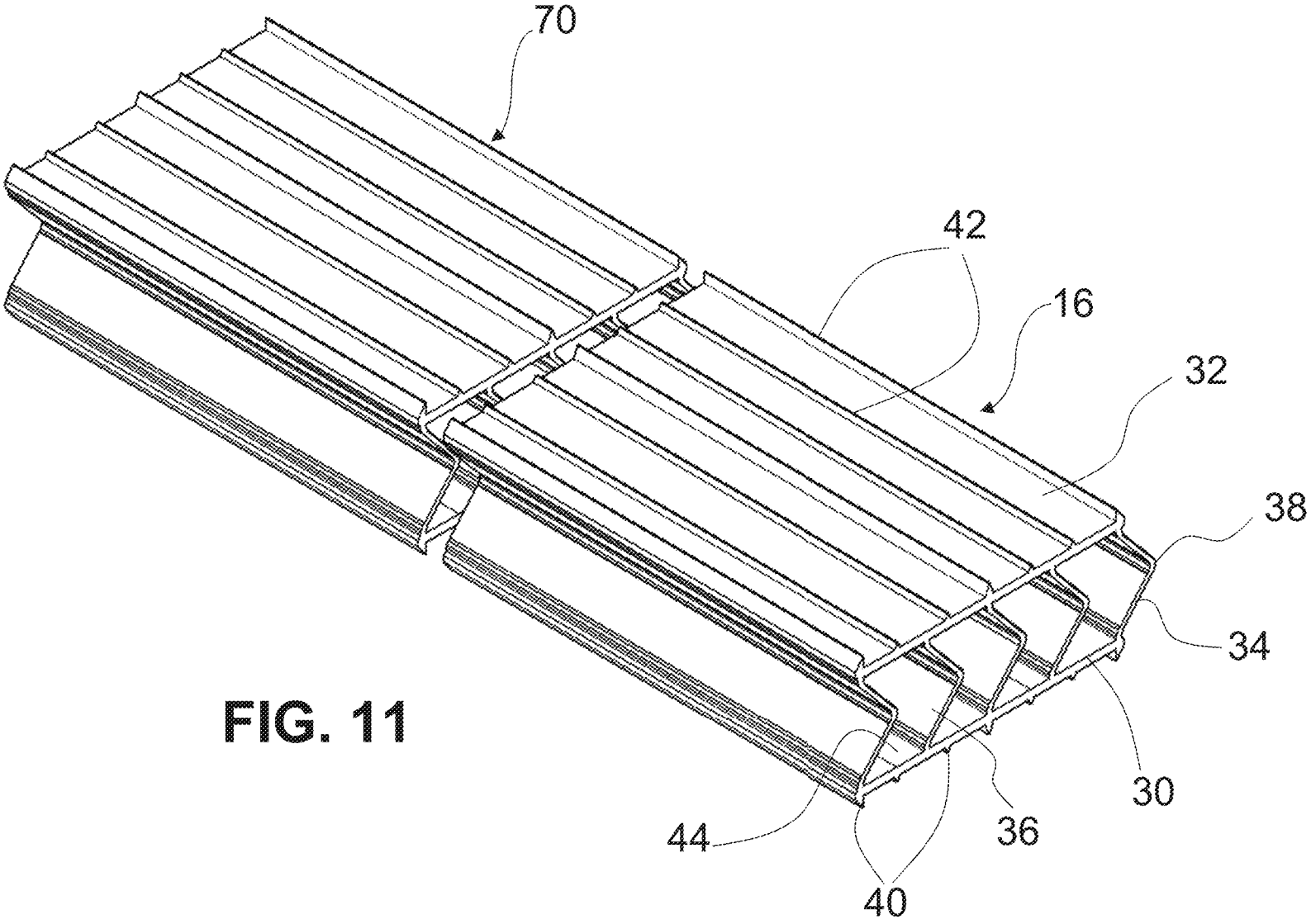
FIG. 11 is an enlarged perspective view of the horizontal seal.
Figure 12:
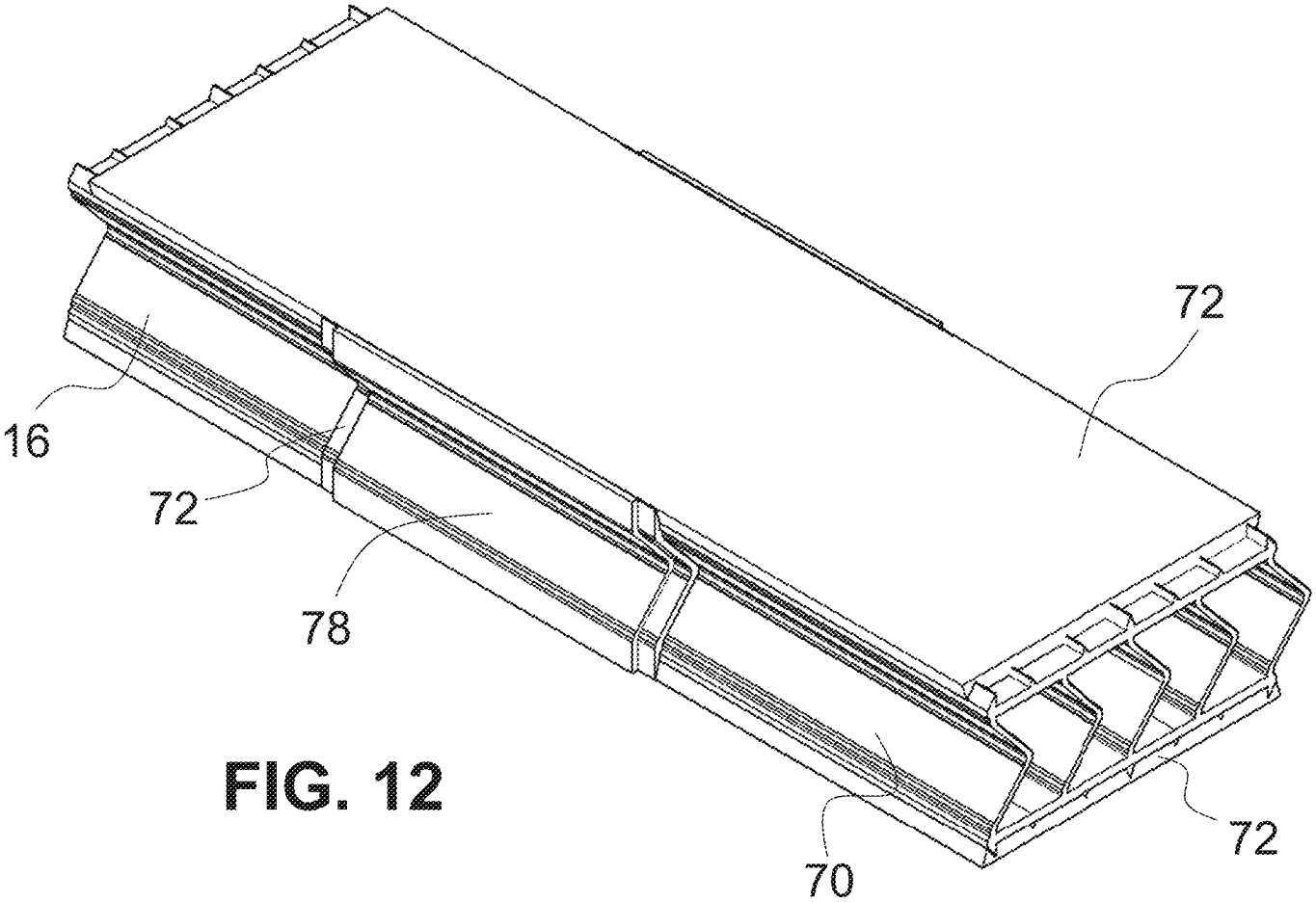
FIG. 12 is enlarged perspective view of the joint between the horizontal seal and the horizontal splice.
Figure 13A:
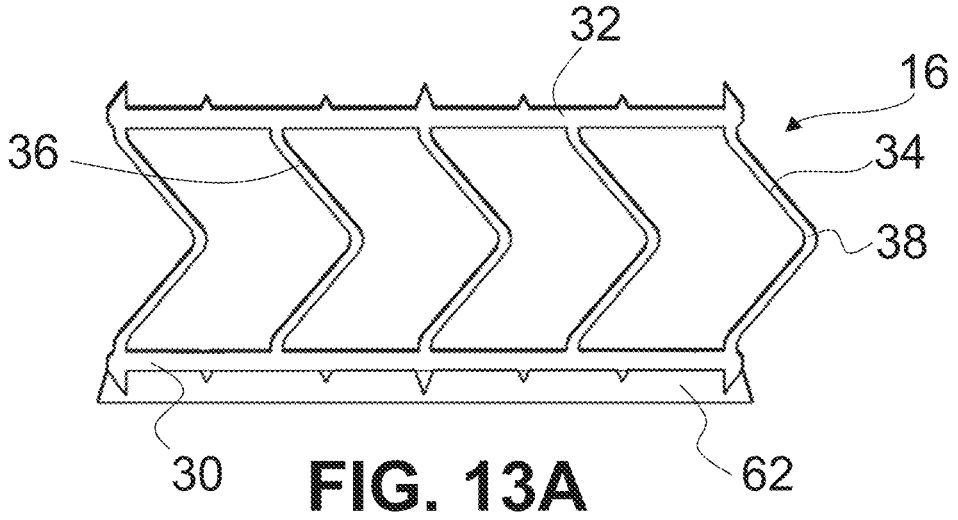
FIG. 13A is a sectional view of the horizontal splice with the bottom seal.
Figure 13B:
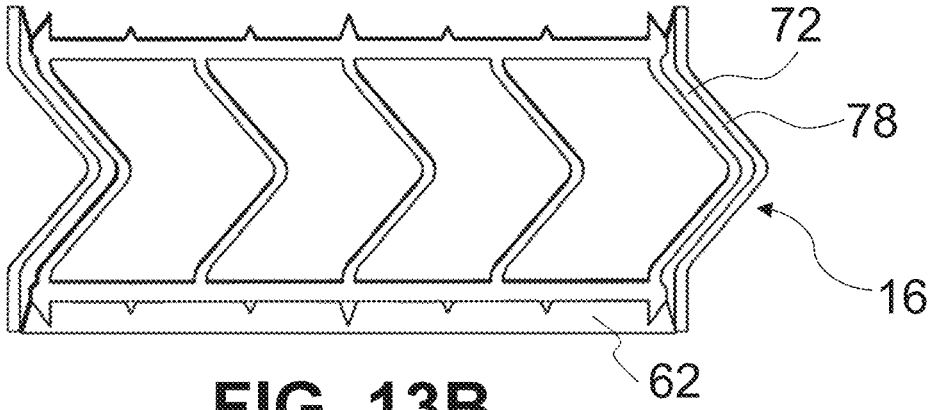
FIG. 13B is a sectional view of the horizontal splice similar to that shown in FIG. 7A but also showing the side seals.
Figure 13C:
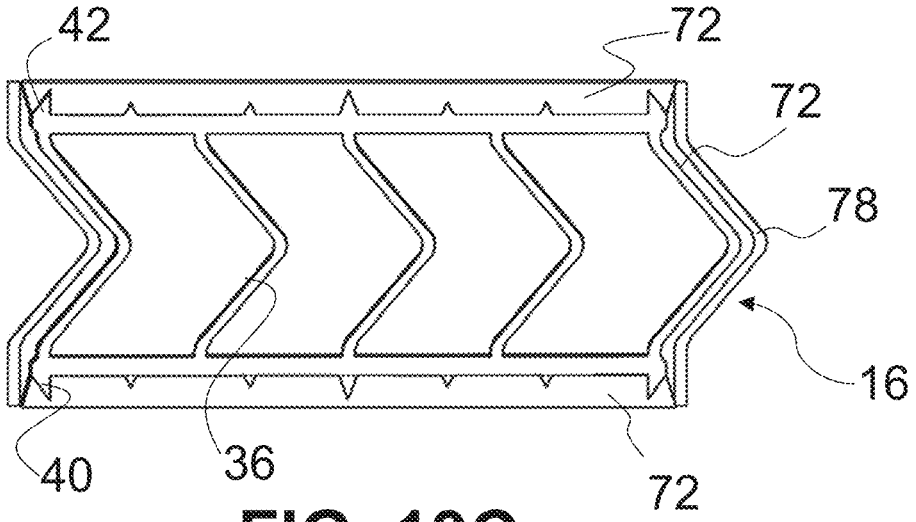
FIG. 13C is a sectional view of the horizontal splice similar to that shown in FIG. 7B but also showing the top seal.

Referring to FIG. 11, the horizontal seal 16 is a tubular member having a base 30 and a top 32 with a pair of spaced apart exterior walls 34 extending therebetween. In addition the horizontal seal 16 has at least one internal wall 36. In the embodiment shown herein there are a plurality of internal walls 36. The base 30 is spaced apart from the top 32. The walls 34 and 36 have bends 38 therein to facilitate the movement of the base 30 relative to the top 32. The base 30 has at least a pair of spaced apart base feet 40 which extend downwardly in line with the walls 34 and 36. The top 32 has at least a pair of spaced apart top feet 42. In the embodiment shown herein the top feet 42 extend upwardly in line with the walls 34 and 36. The base 30, top 32, exterior wall 34 and internal walls 36 form chambers 44. One of ordinary skill in the art will appreciate that the horizontal seal may have any number of chamber walls depending on the width of the horizontal seal. In the embodiment shown herein there are four chambers 44.

The horizontal seal 16 has feet 40 and 42 on the base 30 and top 32 respectively to aid the application of and maintenance of the specified depth for the silicone sealant 72 and to improve the bond between the silicone sealant 72 and the base 30 or top 32. The feet 40 and 42 are elongate feet that extend longitudinally along the length of the horizontal seal 16. The horizontal seal 16 is shaped like a thick, hollow chevron where the exterior wall 34 at the front is concave and the exterior wall 34 at the back is convex. The panel may be assembled such that the horizontal seal does not protrude from the exterior face of the wall thereby decreasing the likelihood that weather will damage the horizontal seal 16.

A horizontal splice 70 is positioned between horizontal seals 16 on adjacent exterior wall panels 12 and sealingly attached thereto. The horizontal splice 70 in cross section is essentially the same as the horizontal seal 16. It is sized to extend between the horizontal seals 16 on adjacent exterior wall panels.

In use, the exterior wall panel assemblies 10 are assembled off site. Off site the vertical seal 14 is affixed to the exterior wall panel 12 and the horizontal seal 16 is affixed to the exterior wall panel. Silicone sealant 72 may be used to affix them. On site the exterior wall panel assemblies 10 are attached to the building structure. The panel assemblies 10 are positioned adjacent to each other such that the vertical seal 14 engages both adjacent panels 12 as best seen in FIG. 4A. Alternatively prior to positioning the panel assembly 10 the exposed vertical side wall 56 may be buttered with silicone sealant 72 as shown in FIG. 5. As further alternative the silicone sealant 72 may be caulked between the vertical seal 14 and the panel 12 after the panel is attached to the building structure.

Figure 10C:
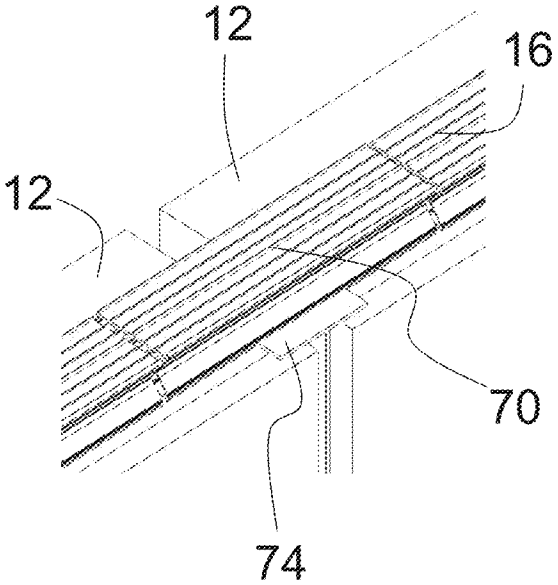
FIG. 10C is a perspective view of the top of two adjacent exterior wall panel assemblies similar to that shown in FIG. 10B but showing the horizontal splice in position.
Figure 10B:
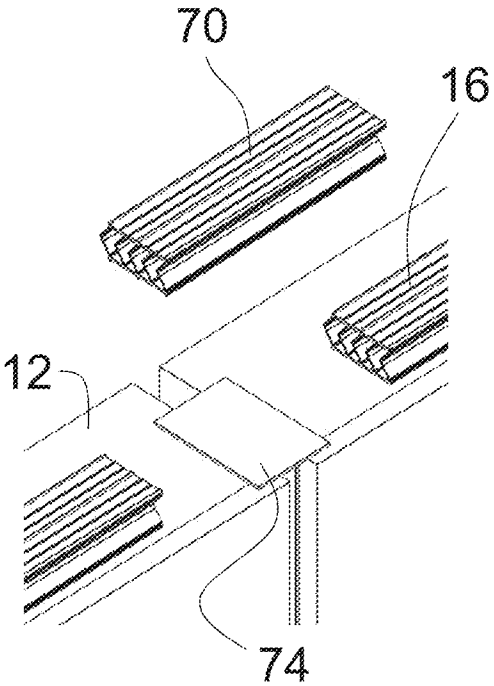
FIG. 10B is a perspective view of the top of two adjacent exterior wall panel assemblies similar to that shown in FIG. 10A but showing the horizontal splice about to be put in position.
Figure 10A:
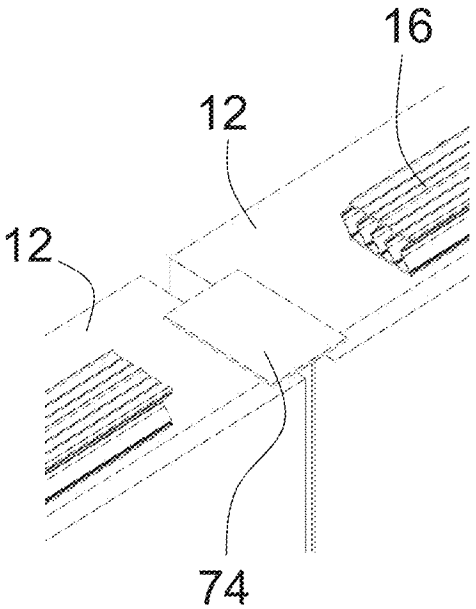
FIG. 10A is a perspective view of the top of two adjacent exterior wall panel assemblies and showing the flexible membrane.

Once adjacent exterior wall panel assemblies 10 are in position the top of the vertical joint seal 14 is buttered with silicone sealant 72 and a flexible membrane 74 is affixed to the top of the vertical joint seal 14. The flexible membrane 74 extends between adjacent wall panels 12 as shown in FIG. 10A and 10B. Thereafter the horizontal splice 70 is positioned and sealed between the horizontal seals 16 on adjacent wall panels 12 as shown in FIGS. 10B and 10C.

The horizontal splice 70 is sealed in place. Referring to FIGS. 12, 13A, 13B and 13C, the horizontal splice 70 is attached at the bottom thereof to a wall panel 12 with silicone sealant 72. This is done by "buttering" the top of the wall panels 12 and the flexible membrane 74 between the horizontal seals 16. The joint between the horizontal splice 70 and the adjacent horizontal seal 16 is then buttered with silicone sealant 72 front and back. A splice flexible membrane 78 is affixed over the joint.

Figure 14:
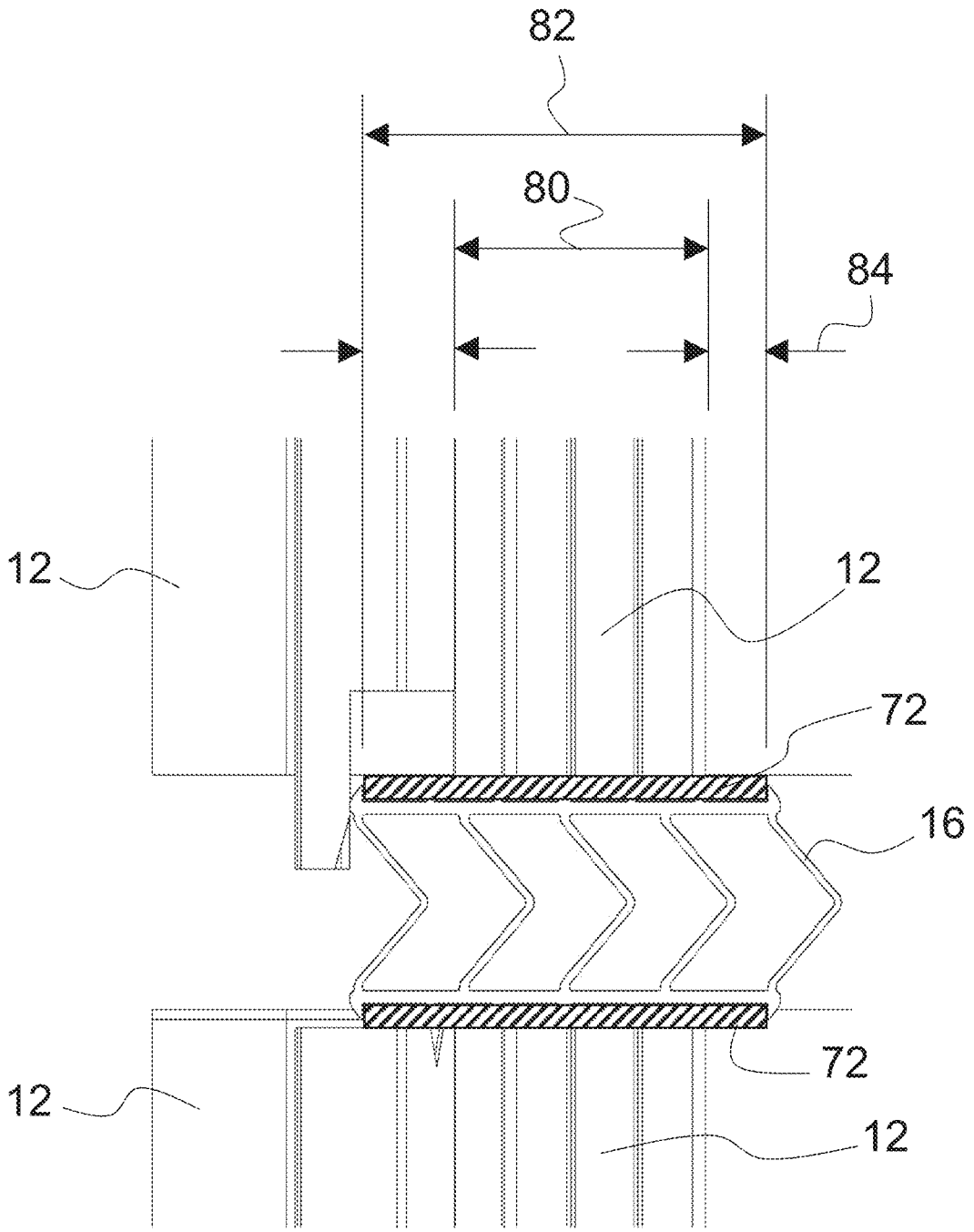
FIG. 14 is a sectional view showing the tolerance between the vertical seal and the horizontal seal.

Thereafter the top of the horizontal seal 16 and the horizontal splice 70 are buttered with silicone sealant 72. The vertically adjacent vertical seal 14 is embedded into the silicone sealant 72 when the next row of exterior wall panel assemblies are attached to the building structure. Referring to FIG. 14 preferably the horizontal seal 16 has four chambers 44 and the vertical seal 14 has two chamber portions 50. The width of the vertical seal 14 is shown at 80 and the width of the horizontal seal 16 is shown at 82. This provides a tolerance between the width of the vertical seal and the width of the horizontal seal as shown at 84.

The horizontal seal 16, the vertical seal 14 and the horizontal splice 70 are made of resilient deformable material such that each has a memory of its original shape. In a preferred embodiment, each is made of a silicone rubber. Preferably the silicone rubber displays elastic properties between a temperature range of −50° C. and +80° C. The vertical seal 100 may be made of a translucent material and the flowable caulking may be coloured thus allowing for a visual check along the length of the chamber portion 50. The vertical seal, 14 or 100 and the rainscreen 52 may be different colours.

It will be appreciated by those skilled in the art that the exterior wall panel assembly 10 will reduce the work that needs to be done on site. By affixing the horizontal seal 16 and the vertical seal 14 to the panel 12 off site the on site labour costs may be reduced. As well, it will be easier to ensure and inspect the quality of seals that are done off site.

It will be appreciated by those skilled in the art that prior art systems have used other types of caulking to form seals. It is particularly useful where there are no sealed chambers because the caulking may be used to fill any holes. In contrast with flowable caulking or self-levelling caulking where there are holes the flowable caulking will just flow out. Using other types of caulking guns (manual or powered), caulking is forced into contact with the sides of the joint to create a bond. After the caulking is gunned into place a tool is used to push the caulking into the joint and remove any voids that exist. Tooling is an important part of traditionally installed caulking joints to ensure quality and consistency of the caulking bead and to insure sufficient pressure has been applied in order to provide adhesion between the substrate and caulked joint. Self-levelling/flowable caulking is also available for applying caulk to horizontal joints such as joints in bridge decks. This type of sealant has not been used to date on vertical joints of buildings because a completely enclosed chamber is required to pour the material into. Previously, it was thought that an enclosed chamber presents a problem because it prevents the sealant from contacting the substrate. The embodiment shown herein however provides an enclosed chamber that can be filled with flowable caulking.

Generally speaking, the systems described herein are directed to exterior wall panel assemblies. Various embodiments and aspects of the disclosure are described in the detailed description. The description and drawings are illustrative of the disclosure and are not to be construed as limiting the disclosure. Numerous specific details are described to provide a thorough understanding of various embodiments of the present disclosure. However, in certain instances, well-known or conventional details are not described in order to provide a concise discussion of embodiments of the present disclosure. The Figs. are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention. For purposes of teaching and not limitation.

As used herein, the terms, "comprises" and "comprising" are to be construed as being inclusive and open ended, and not exclusive. Specifically, when used in the specification and claims, the terms, "comprises" and "comprising" and variations thereof mean the specified features, steps or components are included. These terms are not to be interpreted to exclude the presence of other features, steps or components.

What is claimed is:

1. A vertical seal for use with and to be positioned between two adjacent exterior wall insulated panels and sealant, comprising:

opposed vertical side walls being resiliently deformable;

at least two vertical end walls extending between the opposed vertical side walls, being resiliently deformable and each having a bend therein;

a plurality of ribs extending outwardly from and longitudinally along each vertical side wall of the opposed vertical side walls such that, for each said vertical side wall, the plurality of ribs defines a faying area between the vertical side wall and a corresponding adjacent exterior wall insulated panel of the two adjacent exterior wall insulated panels, and the faying area is configured to receive sealant for affixing the vertical seal to the corresponding adjacent exterior wall panel, wherein a width of the faying area is defined by the plurality of ribs, and a faying area side of each rib of the plurality of ribs is orthogonal to the vertical side wall such that the faying area is an elongate rectangle in cross section; and wherein the opposed vertical side walls and the at least two vertical end walls define at least one cavity and wherein the bend in the vertical end walls facilitates movement of the opposed vertical side walls relative to each other.

2. The vertical seal as claimed in claim 1 wherein the at least two vertical end walls are three spaced apart end walls defining two chambers.

3. The vertical seal as claimed in claim 1 wherein the vertical seal is configured for use with flowable calking.

4. The vertical seal as claimed in claim 3 wherein at least one of the opposed vertical side walls has at least one hole formed therein.

5. The vertical seal as claimed in claim 1 wherein the plurality of ribs each have pointed bearing tips configured to facilitate a continuous seal.

6. The vertical seal as claimed in claim 1 wherein the plurality of ribs have pointed bearing tips.

* * * * *